United States Patent [19]

Seitz

[11] 4,315,585

[45] Feb. 16, 1982

[54] SHEET-FEED TRACTOR WITH ECCENTRIC CLAMPING DEVICE

[75] Inventor: Alan F. Seitz, Harwinton, Conn.

[73] Assignee: Data Motion Incorporated, Torrington, Conn.

[21] Appl. No.: 128,590

[22] Filed: Mar. 10, 1980

[51] Int. Cl.[3] ..... B65H 17/38; B65H 17/52

[52] U.S. Cl. ..... 226/74; 269/236; 269/287; 403/350

[58] Field of Search ..... 226/74, 75, 76, 79; 269/58, 59, 229, 231, 236, 287; 279/77, 78, 81, 102; 403/345, 350, 373, 374, DIG. 4, DIG. 8

[56] References Cited

U.S. PATENT DOCUMENTS

| | | | |
|---|---|---|---|
| 790,590 | 5/1905 | Reynolds et al. | 403/350 X |
| 827,267 | 7/1906 | Schmidt | 403/350 |
| 2,728,616 | 12/1955 | Potter | 403/350 X |
| 3,159,263 | 12/1964 | Goreham . | |
| 3,283,875 | 11/1966 | Davies . | |
| 3,688,959 | 9/1972 | Staneck et al. | 226/75 |
| 3,825,359 | 7/1974 | Fulton | 403/350 X |
| 4,129,239 | 12/1978 | Hubbard | 226/75 |

FOREIGN PATENT DOCUMENTS

| | | | |
|---|---|---|---|
| 1462132 | 11/1966 | France | 403/350 |
| 472858 | 7/1952 | Italy | 403/350 |
| 275213 | 8/1951 | Switzerland | 403/350 |
| 179227 | 5/1922 | United Kingdom | 403/350 |
| 556389 | 10/1943 | United Kingdom | 403/350 |

*Primary Examiner*—Stanley N. Gilreath

[57] ABSTRACT

A sheet-feed tractor includes clamp means made of two members through which a passage is provided defined partly by both members. One member is pivotably mounted on the other in such a manner that the size of the passage is reduced by pivoting of the pivotable member. Reduction of the size of the passage can clamp a support shaft received in the passage, and the clamping force tends to enhance the static friction between the members so as to keep the clamping means in clamping position.

17 Claims, 9 Drawing Figures

SHEET-FEED TRACTOR WITH ECCENTRIC CLAMPING DEVICE

BACKGROUND OF THE INVENTION

The present invention relates to sheet-feed tractors of the type used, for example, in the data-processing field for automatically advancing paper on which data is to be printed. In particular, the present invention is directed to novel means for clamping the sheet-feed tractor on a support shaft.

The typical sheet-feed tractor includes a toothed belt mounted on the tractor body and propelled by a drive sprocket. The drive sprocket is driven by a drive shaft that rotates to cause the drive belt to follow a path around the tractor. In operation, the teeth of the moving drive belt are received in perforations in sheet material and advance the sheet material whenever a new line is to be typed.

Sheet-feed tractors are typically used in pairs, one for each edge of the perforated paper. A support shaft spaced from the drive shaft extends through openings in the tractor bodies, and the tractors are clamped to the support shaft at the spacing necessary to allow the teeth on both belts to register simultaneously with the perforations in the sheet material. The support shaft also prevents the tractor from rotating with the drive shaft.

Because sheet material of different widths may be used, it is desirable that the tractors permit clamping and unclamping to be performed with relative ease. Numerous clamping mechanisms have been proposed to provide this ease of adjustment. These are exemplified, for instance, by U.S. Pat. No. 4,129,239 to Hubbard, which employs a clamp consisting of two members, one of which includes a split ring that surrounds the support shaft, the other of which includes a ring with flats on its interior surface that encircles the split ring and compresses it upon being rotated. Compression of the split ring causes it to bear against the support shaft and thereby clamp the tractor in place. To leave room for tolerances in support shafts and related equipment, clamps of the type described in Hubbard are slidably mounted in the tractor.

Although the arrangements exemplified by the Hubbard patent provide for rapid adjustment of sheet width, they also have features that detract from flexibility and ease of manufacture. In particular, the split-ring portion must be resiliently deflected in use to provide proper clamping. When the materials typically employed are considered, this results in the requirement that the difference in diameter between the open and closed positions of the clamp be relatively small so as to avoid excessive strain and fatigue of the split ring. Relatively close tolerances on the split ring are therefore desirable, but the manufacturing process is not as simple as might be desired. Furthermore, the requirement has resulted that the diameter of the support shaft be kept within a relatively small range so that the clamp can be effective. This requires relatively expensive shafts and reduces the versatility of the tractor.

It is accordingly an object of the present invention to permit fast and easy clamping on shafts whose diameters vary significantly. It is a further object to achieve this effect in a clamp that is subjected to very little resilient deflection in use.

SUMMARY OF THE INVENTION

The foregoing and related objects are achieved in a sheet-feed tractor, including a tractor body having a support-shaft opening through it and clamp means mounted on the body and having a support-shaft passage aligned with the support-shaft opening in the body. The clamp means includes first and second clamp members, each having an interior wall portion, and the wall portions define the support-shaft passage. The first clamp member extends outwardly from the body and is nonrotatably mounted thereon. The second clamp member is pivotably mounted on the first clamp member for providing about a pivotal axis that preferably extends through the passage. The passage-defining wall portions on the first and second clamp members have first and second opposed shaft-clamping wall portions, respectively along a common axial length of the support-shaft passage defined thereby for at least a portion of their axial length, and pivoting of the second clamp member on the first clamp member effects relative movement of the shaft-clamping wall portions to reduce or increase the maximum transverse spacing between them diametrically of the passage that they define. Clamping is thereby possible, by pivoting of the second clamp member, of a shaft received in the support-shaft passage whose width is within the range of transverse spacings provided by the shaft-clamping wall portions with the shaft being clamped between the opposed portions of said clamping surfaces along the common axial length of the support-shaft passage.

Preferably, the second clamp member includes a ring portion that has an inner aperture-defining surface providing the shaft-clamping wall portion of the second clamp member along a portion thereof. The first clamp member includes a projection portion extending into the aperture of the ring portion of the second clamp member, the projection portion having a first surface providing the shaft-clamping wall portion of the second clamp member and also having a second surface opposite the first surface. The second surface of the projection portion and the inner surface of the ring portion include slidably engaged arcuate mating surfaces having a common axis of curvature coincident with the pivotal axis. The sliding engagement permits sliding of the arcuate mating surfaces along each other during pivoting of the second clamp member relative to the first clamp member.

The second clamp member includes a lever portion extending from the ring portion to facilitate manual pivoting of the second clamp member.

The first and second clamp members may conveniently have mating cylindrical surfaces whose axes are coincident with the pivotal axis. The cylindrical mating surfaces are slidably engaged for sliding relative to each other during pivoting of the second clamp member relative to the first clamp member.

In one of the illustrated embodiments, one of the shaft-clamping wall portions includes two substantially planar surfaces inclined relative to each other and meeting to form a corner for wedging of a support shaft into the corner upon pivoting of the second clamp member. In both embodiments, at least one of the shaft-clamping wall portions provides an arcuate surface for engaging a shaft received in the support-shaft passage, and both of the shaft-clamping wall portions are arcuate in shape in another embodiment.

BRIEF DESCRIPTION OF THE DRAWINGS

These and further features and advantages of the present invention are described in connection with the accompanying drawings, in which.

DETAILED DESCRIPTION OF THE PREFERRED EMBODIMENT

Figure 1:
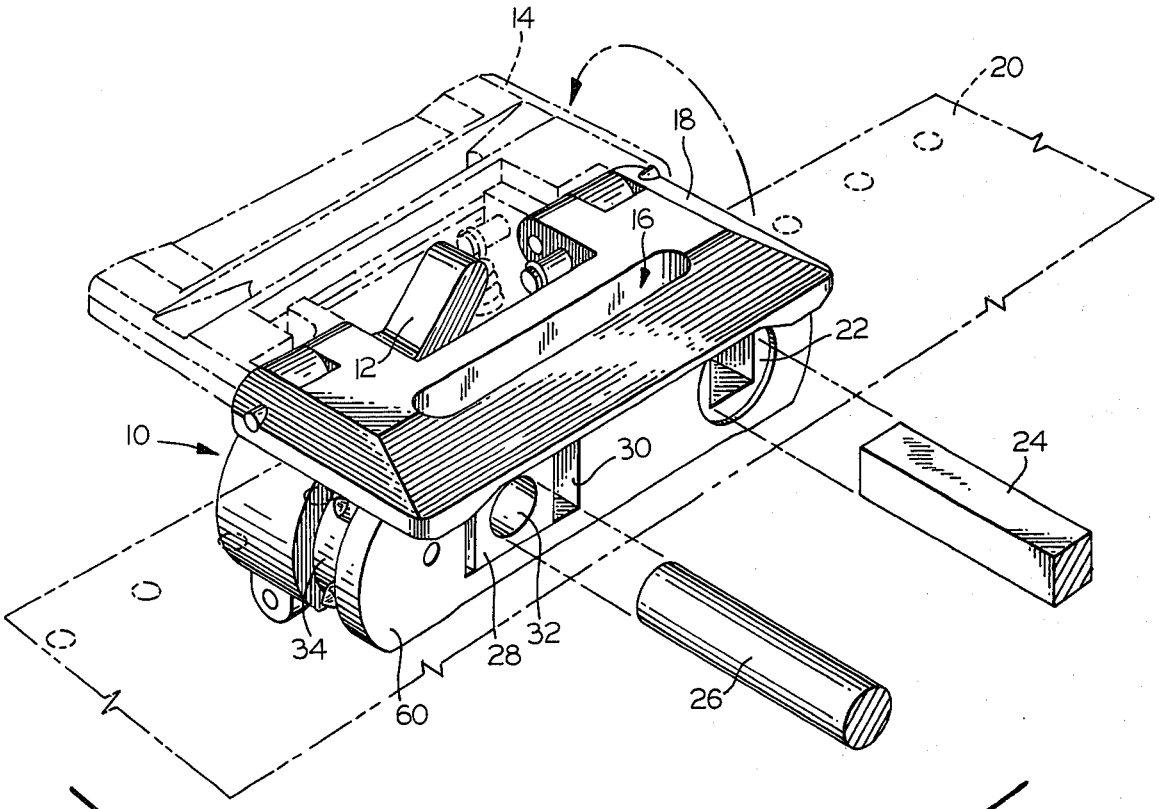
FIG. 1 is a perspective view of a sheet-feed tractor employing the teachings of the present invention.
Figure 2:
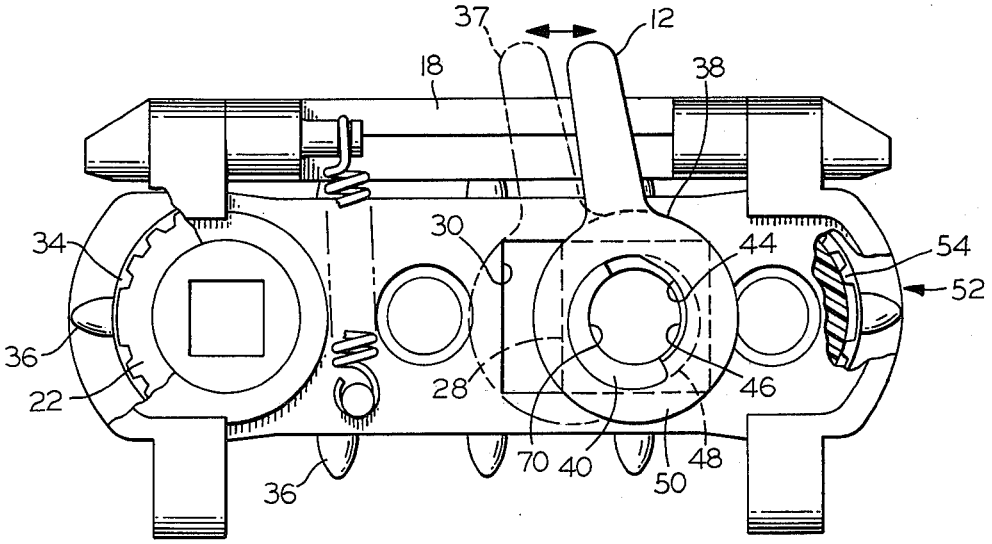
FIG. 2 is a side elevation of the tractor of FIG. 1.
Figure 3:
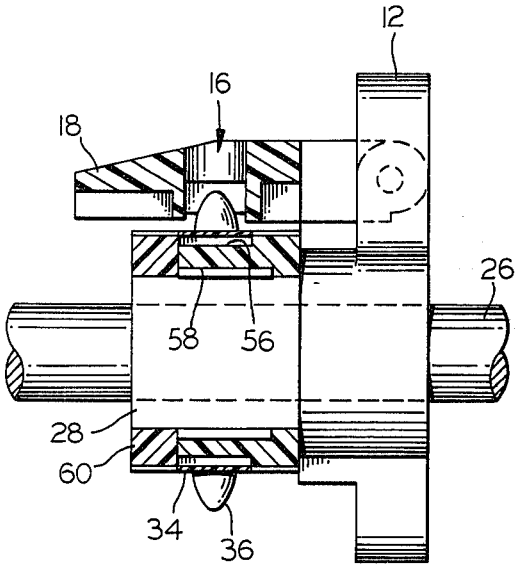
FIG. 3 is an end view, partly in section, of the tractor of FIG. 1.

FIGS. 1 through 3 illustrate a sheet-feed tractor that includes a tractor body 10 and a clamp means including first and second clamp members 28 and 38. By operation of a lever 12 provided on the second member 38 of the clamp means, the tractor can be clamped onto a support shaft 26 extending through the tractor.

As FIG. 1 illustrates, tractor body 10 provides a rectangular opening 30 in which clamp member 28 is slidably received. Clamp member 28 has a bore 32 therethrough that defines part of a support-shaft passage through the clamp means. A cylindrical support shaft 26 extends through passage 32, and once shaft 26 is in place, pivoting of a lever 12 will cause shaft 26 to be clamped, as will be described in more detail below.

Longitudinally spaced from support shaft 26 is a drive shaft 24 that is square in cross section. It is received in a square opening in a drive sprocket 22 that is rotatably mounted in tractor body 10 at a position spaced from opening 30. By virtue of their relative positions, support shaft 26 and drive shaft 24 orient the tractor at the proper angle.

As FIG. 2 shows, an endless belt 34 is drivingly engaged by sprocket 22, and rotation of drive shaft 24 results in movement of teeth 36 provided on endless belt 34 along a path provided by the tractor body. Teeth 36 engage holes in sheet material suggested by phantom 20 (FIG. 1) that extends through the space provided between a paper guide 18 and the upper portion of the tractor body. As is best seen in FIG. 3, guide 18 provides a longitudinally extending opening 16 that accommodates teeth 36 of endless belt 34. Paper guide 18 thus serves to keep the paper engaged with teeth 36. As is suggested by phantom 14 of FIG. 1, guide 18 can be rotated out of the way when the paper is to be initially put into place or removed.

Figure 4:
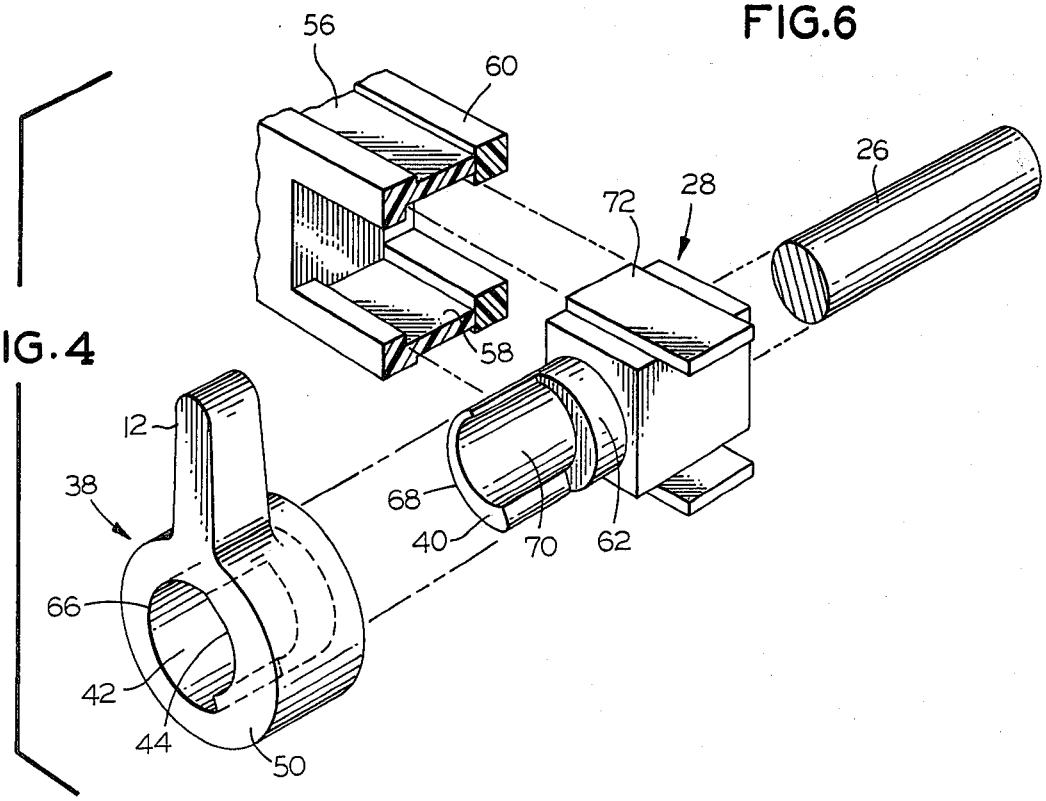
FIG. 4 is an exploded view of the clamp means and related portions of the tractor of FIG. 1.

The clamp means is best seen in FIG. 4, which shows that it consists of first and second members 28 and 38. The first clamp member 28 includes a block portion having lands 72 that are received in recesses 58 in the tractor body. In FIG. 4, lands 72 are shown extending from the block in ears, which may be included if it is desired to increase the rigidity of the angular position of member 28 relative to tractor body 10. Depending on the length of the ears, clamp member 28 may or may not be permitted to slide longitudinally of the tractor. Sliding is desirable because tractors to be used with different-sized support shafts must accommodate different spacings between shafts.

Extending from the block portion of the first clamp member 28 is a cylindrical portion 62 that provides a cylindrical surface on which the second clamp member 38 is mounted. A generally arcuate projection portion 40 projects from cylindrical portion 62. It includes an external arcuate bearing surface 68 and an internal shaft-clamping wall portion 70 opposite external bearing surface 68.

Clamp member 28 is assembled into tractor body 10 before a rear plate 60 is fastened into place to hold clamp member 28 in its track.

Second clamp member 38 includes a ring portion 50 having a central aperture 42. The wall providing aperture 42 includes a shaft-clamping wall portion 44 that is disposed opposite shaft-clamping wall portion 70 of first clamp member 28. The two shaft-clamping wall portions are employed in use to bear oppositely against shaft 26 to hold the tractor in place.

Figure 5:
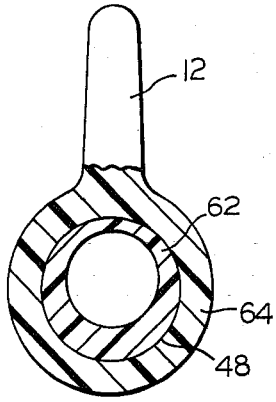
FIG. 5 is a partly sectional view of the cylindrical portions of the two clamp members.

FIG. 5 shows a section through the cylindrical portions of clamp members 28 and 38. The section is taken to the rear of shaft-clamping wall portion 44, where the aperture-defining wall of clamp member 38 is cylindrical. This cylindrical section 64 of second clamp member 38 has an inner surface that mates with the outer surface of cylindrical section 62 of first clamp member 28. Reference numeral 48 refers to the interface between the two clamp members at their respective cylindrical portions.

It is to be noted in FIG. 5 that the pivotal axis, which is the axis of the cylinder defined by interface 48, is spaced downwardly from the axis of the interior bore of cylindrical portion 62 of first clamp member 28. On account of the spacing of these axes, portions of clamp member 38, while maintaining their distances from the pivotal axis during pivoting of member 38, can change their distances from the axis of the bore through cylindrical portion 62.

Figure 6:
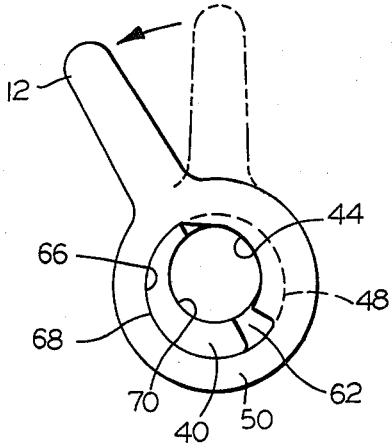
FIG. 6 is an elevation of the clamp means with the levered member pivoted somewhat from the position shown in FIG. 5.

The effect of this spacing of axes can be seen by comparison of FIGS. 2 and 6. It can be seen in FIG. 2 that shaft-clamping wall portion 70 of projection portion 40 presents an arcuate surface whose axis of curvature coincides with the center of the bore through first clamp member 28. Shaft-clamping wall portion 44 is also arcuate, but it is provided by second clamp member 38, whose pivotal axis is spaced from the axis of curvature of shaft-clamping wall portion 70. Pivoting of clamp member 38 therefore has the effect shown in FIG. 6, in which shaft-clamping wall portion 44 is spaced closer to shaft-clamping wall portion 70 than it is in FIG. 2. Consequently, the transverse spacing between the shaft-clamping wall portions diametrically of the passage that they define in reduced; i.e., the size of the shaft that can be received in the passage is reduced. As a result, it is possible to clamp a shaft whose diameter is within the range of transverse spacings provided by pivoting clamp member 38.

It should be noted that the clamping force tends to maintain the clamp in its clamping position even though the resilient deflection required of the parts is negligible. This can be appreciated by reference to FIG. 6, where it is seen that the exterior surface 68 of projection portion 40 constitutes a bearing surface that mates with a bearing portion 66 of the interior wall that defines aperture 42 of ring portion 50. When lever 12 is pivoted to reduce the transverse spacing, shaft-clamping wall portions 44 and 70 bear against support shaft 26, and a force is exerted between bearing surfaces 66 and 68 as a result. Due to this force, which occurs only during clamping, the static friction between bearing surfaces 66 and 68 tends to maintain the clamp in its clamping position. Of course, the clamping action also increases friction between the mating cylindrical surfaces of the two clamp members that form interface 48, but it is apparent that the force resulting from clamping is most effective on bearing surfaces 66 and 68, which are adjacent shaft-clamping wall portions 44 and 70.

It may be observed that the axis of curvature of shaft-clamping wall portion 44 is not the same as the pivotal axis, even though shaft-clamping wall portion 44 is provided by clamp member 38, which pivots about the pivotal axis. This difference in axes is convenient because it provides particularly satisfactory engagement with a support shaft 26 of the intended size. However, it is clear that such an offset of axes is not required; even if the axis of curvature of shaft-clamping wall portion 44 were the same as the pivotal axis, the transverse spacing between the shaft-clamping wall portions would still be reduced or increased by pivoting of clamp member 38.

Figure 8:
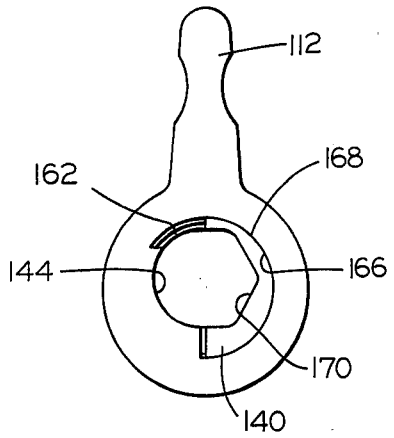
FIG. 8 is a view similar to FIG. 6 of the clamp means of FIG. 7.
Figure 9:
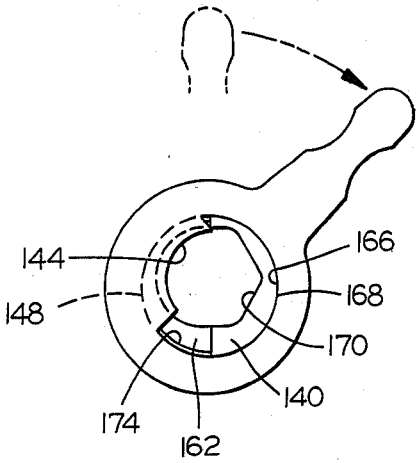
FIG. 9 is a view similar to FIG. 8 with the levered member rotated somewhat from the position shown in FIG. 8.
Figure 7:
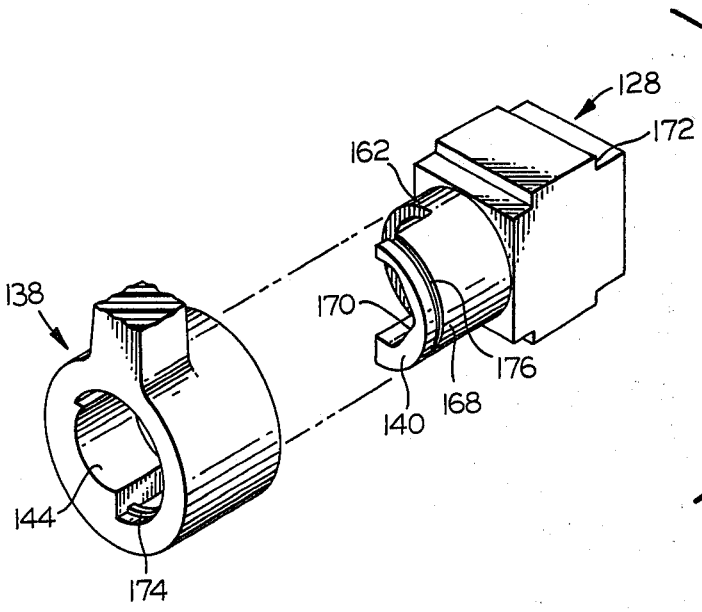
FIG. 7 is an exploded view of an alternate arrangement of the clamp means.

FIGS. 7 through 9 depict an alternate arrangement of the clamping means. It has been found that the arrangement in FIGS. 7 through 9 is particularly forgiving of variations in shaft diameter. The clamp means consists of first and second clamp members 128 and 138, respectively. Like member 28 of FIG. 4, clamp member 128 of FIG. 7 includes a cylindrical portion 162 and a projecting portion 168. Unlike clamp member 28, however, clamp member 128 has a shaft-clamping wall portion 170 that is made of a number of planar surfaces inclined relative to each other to form corners into one or more of which it is intended that the support shaft be wedged by the action of the clamp.

Clamp member 138 is generally similar to clamp member 38 of FIG. 4, having a shaft-clamping wall portion 144 provided by the interior aperture-defining wall. Unlike FIG. 4, FIG. 7 also illustrates an arcuate snap rib 174 on the aperture-defining wall that snaps into a complementary snap slot 176 provided on the exterior surface of projection portion 140. The arrangement of FIG. 4 would also have such a rib-slot combination, but this feature is omitted from FIG. 4 for the sake of simplicity.

FIGS. 8 and 9 illustrate two extreme positions of the clamping means. In FIG. 8, in which lever portion 112 is in its upright position, second clamp member 138 is in its extreme counterclockwise position. It is noted that in this position the shaft-clamping wall portion 144 of movable clamp member 138 is generally opposite a portion of shaft-clamping wall portion 170 of stationary clamp member 128 that is spaced relatively far from the pivotal axis. As a consequence, the transverse spacing of the passage defined by the shaft-clamping wall portions is relatively great. As pivotable clamp member 138 is pivoted in the clockwise direction, shaft-clamping wall portion 144 moves toward a position in which it is opposite the portion of shaft-clamping wall portion 170 that is spaced more closely to the pivotal axis. Consequently, the transverse spacing of the passage is reduced, and a support shaft whose diameter is between the extreme transverse spacings can be clamped by pivoting of clamp member 138. The pivoting of clamp member 138 tends to wedge the support shaft into one of the corners provided by the planar surface portions of shaft-clamping wall portion 170.

It will be apparent from the foregoing description that it is possible to accommodate quite a large range of support-shaft sizes by following the teachings of the present invention. In particular, it should be noted that a very wide range can be provided by spacing the center of the stationary bore a considerable distance from the pivotal axis. A large spacing tends to result in a significant amount of relative movement and thus a large range of support-shaft sizes that can be accommodated. This range is provided despite the fact that there is no necessity for any significant resilient deflection of any of the parts of the clamp.

Having thus described the invention, I claim:

1. In a sheet-feed tractor adapted to be slidably mounted on substantially parallel elongated support and drive shafts, the combination comprising:

a. a tractor body having a support-shaft opening therethrough;

b. a drive sprocket rotatably mounted in said tractor body and adapted to receive the drive shaft for sliding therealong and driving thereby upon rotation of the drive shaft about its longitudinal axis;

c. an endless belt disposed about said tractor body in engagement with said drive sprocket for driving thereby upon driving of said sprocket by the drive shaft, said drive belt including sheet-engagement teeth adapted for engagement of perforated sheet material and advancement thereof upon driving of said drive belt by said sprocket; and d. clamp means mounted on said body and having a support-shaft passage aligned with said support-shaft opening in said body for slidable reception of the support shaft therein, said clamp means including first and second clamp members each having an interior wall portion, said wall portions of said clamp members defining said support-shaft passage, said first clamp member extending outwardly from said body and being nonrotatably supported thereon, said second clamp member being pivotably mounted on said first clamp member for pivoting thereabout and about a pivotal axis extending through said passage, said passage-defining wall portions on said first and second clamp members having first and second opposed shaft-clamping wall portions respectively, along a common axial length of said support-shaft passage defined thereby for a portion of their axial length, pivoting of said second clamp member on said first clamp member effecting relative movement of said shaft-clamping wall portions to reduce or increase the maximum transverse spacing therebetween diametrically of the passage defined thereby, pivoting of said second clamp member thereby clamping the support shaft between opposed portions of said clamping surfaces along said common axial length of said support-shaft passage or releasing it to permit sliding therealong if its width is within the range of transverse spacings provided by said shaft-clamping wall portions.

2. The combination of claim 1 wherein:

a. said second clamp member includes a ring portion having an inner aperture-defining surface providing said shaft-clamping wall portion of said second clamp member along a portion thereof;

b. said first clamp member includes a projection portion extending into said aperture of said ring portion of said second clamp member, said projection portion having a first surface providing said shaft-clamping wall portion of said first clamp member and also having a second surface opposite said first surface;

c. said second surface of said projection portion and said inner surface of said ring portion include slidably engaged arcuate mating surfaces having a common axis of curvature coincident with said pivotal axis, said sliding engagement permitting sliding of said arcuate mating surfaces along each other during pivoting of said second clamp member relative to said first clamp member.

3. The combination of claim 2 wherein said second clamp member includes a lever portion extending from said ring portion to facilitate manual pivoting of said second clamp member.

4. The combination of claim 2 wherein said first and second clamp members have mating cylindrical surfaces whose axes are coincident with said pivotal axis, said cylindrical mating surfaces being slidably engaged for sliding relative to each other during pivoting of said second clamp member relative to said first clamp member.

5. The combination of claim 4 wherein at least one of said shaft-clamping wall portions includes two substantially planar surfaces inclined relative to each other and meeting to form a corner for wedging of a support shaft into said corner upon pivoting of said second clamp member.

6. The combination of claim 5 wherein at least one of said shaft-clamping wall portions provides an arcuate surface for engaging a shaft received in said support-shaft passage.

7. The combination of claim 1 wherein said first and second clamp members have mating cylindrical surfaces whose axes are coincident with said pivotal axis, said cylindrical mating surfaces being slidably engaged for sliding relative to each other during pivoting of said second clamp member relative to said first clamp member.

8. The combination of claim 7 wherein at least one of said shaft-clamping wall portions provides an arcuate surface for engaging a shaft received in said support-shaft passage.

9. The combination of claim 8 wherein both of said shaft-clamping wall portions are arcuate in shape.

10. The combination of claim 8 wherein at least one of said shaft-clamping wall portions includes two substantially planar surfaces inclined relative to each other and meeting to form a corner for wedging of a support shaft into said corner upon pivoting of said second clamp member.

11. In a sheet-feed tractor adapted to be slidably mounted on substantially parallel elongated support and drive shafts, the combination comprising:

a. a tractor body having a support-shaft opening therethrough;

b. a drive sprocket rotatably mounted in said tractor body and adapted to receive the drive shaft for sliding therealong and driving thereby upon rotation of the drive shaft about its longitudinal axis;

c. an endless belt disposed about said tractor body in engagement with said drive sprocket for driving thereby upon driving of said sprocket by the drive shaft, said drive belt including sheet-engagement teeth adapted for engagement of perforated sheet material and advancement thereof upon driving of said drive belt by said sprocket; and d. clamp means mounted on said tractor body and having a support-shaft passage aligned with said support-shaft opening in said body, said clamp means including first and second clamp members each having an interior wall portion, said wall portions of said clamp members defining said support-shaft passage, said first clamp member extending outwardly from said body and being nonrotatably supported thereon, said second clamp member being pivotally mounted on said first clamp member for pivoting thereabout and about a pivotal axis, said passage-defining wall portions on said first and second clamp members having first and second opposed shaft-clamping wall portions respectively, along a common axial length of said support-shaft passage defined thereby for a portion of their axial length, said second clamp member including a ring portion having an inner aperture-defining surface providing said shaft-clamping wall portion of said second member along a portion thereof, said first clamp member including a projection portion extending into said aperture of said ring portion of said second clamp member, said projection portion having a first surface providing said shaft-clamping wall portion of said second clamp member and also having a second surface opposite said first surface, said second surface of said projection portion and said inner surface of said ring portion including slidably engaged arcuate mating surfaces having a common axis of curvature coincident with said pivotal axis, said sliding engagement permitting sliding of said arcuate mating surfaces along each other during pivoting of said second clamp member relative to said first clamp member, pivoting of said second clamp member on said first clamp member effecting relative movement of said shaft-clamping wall portions to reduce or increase the maximum transverse spacing therebetween diametrically of the passage defined thereby, pivoting of said second clamp member thereby clamping the support shaft between opposed portions of said clamping surfaces along said common axial length of said support-shaft passage or releasing it to permit sliding therealong if its width is within the range of transverse spacings provided by said shaft-clamping wall portions, clamping of a shaft between said shaft-clamping wall portions tending to press said arcuate mating surfaces together to increase friction therebetween to maintain said second member in clamping position.

12. The combination of claim 11 wherein said first and second clamp members have mating cylindrical surfaces whose axes are coincident with said pivotal axis, said cylindrical mating surfaces being slidably engaged for sliding relative to each other during pivoting of said second clamp member relative to said first clamp member.

13. The combination of claim 12 wherein at least one of said shaft-clamping wall portions includes two substantially planar surfaces inclined relative to each other and meeting to form a corner for wedging of a support shaft into said corner upon pivoting of said second clamp member.

14. The combination of claim 13 wherein at least one of said shaft-clamping wall portions provides an arcuate surface for engaging a shaft received in said support-shaft passage.

15. The combination of claim 12 wherein at least one of said shaft-clamping wall portions provides an arcuate surface for engaging a shaft received in said support-shaft passage.

16. The combination of claim 15 wherein both of said shaft-clamping wall portions are arcuate in shape.

17. The combination of claim 1, 2, 4, 5, 6, 7, 8, 10, 11, 12, 13, or 15 wherein said clamp means is slidably mounted in said tractor body to permit sliding of said tractor body relative to a support shaft when said clamp means is clamped on the support shaft.

* * * * *